United States Patent [19]

Köhnlein et al.

[11] 4,022,373

[45] May 10, 1977

[54] PACKAGE WITH REINFORCING INSERT

[75] Inventors: Rolf Köhnlein, Nagold; Klaus Domke, Ditzingen; Walter Bandle, Rommelshausen; Helmut Schöttle, Freiberg (Neckar), all of Germany

[73] Assignee: Fr. Hesser Maschinenfabrik AG, Stuttgart, Germany

[22] Filed: Dec. 15, 1975

[21] Appl. No.: 640,474

[30] Foreign Application Priority Data

Dec. 14, 1974 Germany ..... 7441619[U]

[52] U.S. Cl. ..... 229/51 AS; 229/87 R; 426/124; 426/396

[51] Int. Cl.[2] ..... B65D 5/54; B65D 65/32; B65D 65/34

[58] Field of Search ..... 229/87 C, 51 AS, 51 C, 229/87 G, 87 R, 14 BA, 14 R, 55, 51 TS; 426/122, 123, 124, 396

[56] References Cited

UNITED STATES PATENTS

| | | | |
|---|---|---|---|
| 1,516,455 | 11/1924 | Panza | 229/87 C |
| 1,725,869 | 8/1929 | Kornsweet | 229/87 C X |
| 2,141,252 | 12/1938 | Prindle | 229/51 AS |
| 2,808,194 | 10/1957 | Dols | 229/87 R |
| 2,811,455 | 10/1957 | Erekson | 229/55 X |
| 3,333,683 | 8/1967 | Scharre | 229/87 C X |
| 3,764,351 | 10/1973 | Whittington et al. | 229/51 TS X |

*Primary Examiner*—Stephen P. Garbe
*Attorney, Agent, or Firm*—Edward E. Sachs

[57] ABSTRACT

A package for coffee or the like of tubular configuration having an outer sleeve and a tubular reinforcing member within the sleeve. A tear strip is located between the sleeve and the reinforcing member at the upper end of the package to provide a common and flush end with the reinforcing member. The narrow strip peripherally surrounds the reinforcing member and projects outwardly from the package. The package has a fin-seal closure.

5 Claims, 2 Drawing Figures

PACKAGE WITH REINFORCING INSERT

Figure 1:
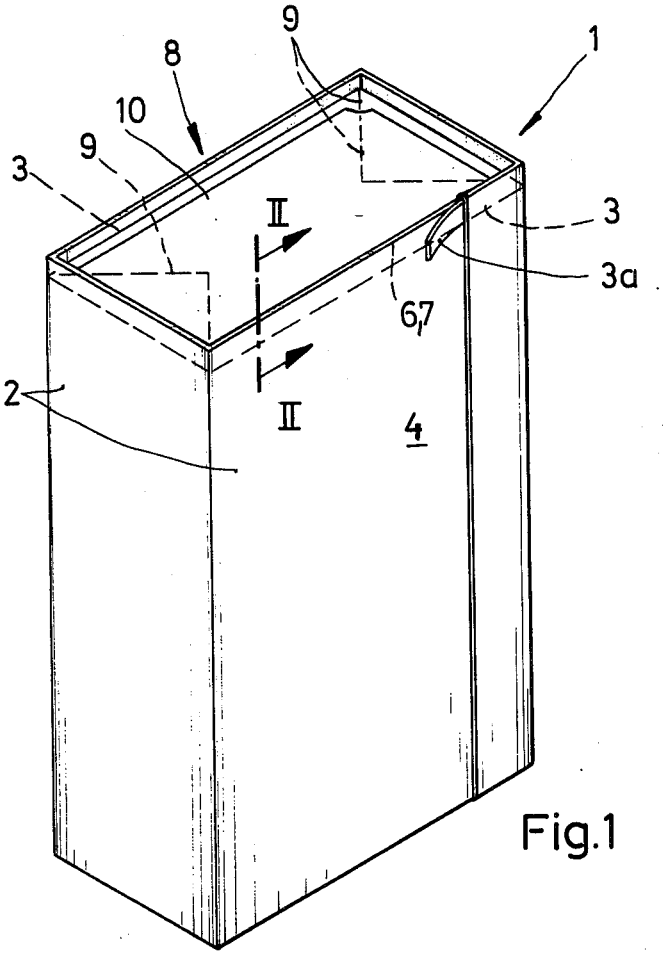

The invention relates generally to a package and, more particularly, to a bag-like package provided with a reinforcing isert formed, for example, of carton type material.

In the prior art, as exemplified by U.S. Pat. Nos. 255,414; 2,409,998; 2,567,267 and 2,766,926, packages are already known, for coffee or similar goods having relatively sharp corners or edges. The packages comprise bag-like sleeves and cardboard reinforcements, of essentially tubular configuration, arranged within the package. In order to maintain the appearance of attractiveness of the package and to avoid leaks from the sleeves, it is necessary to bond, or adhesively secure, at least the edges of the reinforcement to the sleeve. This is particularly important when the package must pass through an evacuation station during the filling and closing process, which could cause the goods to penetrate between the reinforcement and the sleeve.

However, such packages of the prior art do not lead themselves to be constructed with tear strings or strips which today are commonly desired; for packages of this type see German Patent Publication OS No. 2,046,484. Herein, the cover of the sleeve which is separated by the tear string cannot be torn off.

In order to obviate the above described shortcomings of the prior art, the present invention provides a tear strip which is secured substantially flush with the edge of the tube-like reinforcement member. The string or strip is not only adhesively attached to the tube for removal, but is also secured to the outer sleeve of the package.

In the package in accordance with the present invention, the detachable connection between the tear strip and the reinforcement member provides a seal which prevents the intrusion of particulates or goods between the reinforcing member and the sleeve provided with the tear strip. While the seal is destroyed upon removal of the strip, the same is, however, at that time no longer necessary after the package has been opened for use of the contents.

It is therefore the primary object of the present invention to provide a package which overcomes the above discussed shortcomings of prior art devices, improves structural integrity, and facilitates the use of such improved packages in conjunction with highly automated packaging machinery comprising filling, evacuation and closing stations.

An aspect of the present invention resides in providing a package which includes a closed outer sleeve of generally bag-like configuration and a generally tubular reinforcing member which extends within the outer sleeve, at least in the upper region thereof, with the reinforcing member being secured, at least in part, to the sleeve. A flat tear strip is interposed between the outer sleeve and the tubular reinforcing member and is detachably attached to the reinforcing member and connected to the outer sleeve. The strip and the tubular reinforcing member define a common end arranged substantially flush with respect to each other.

For a better understanding of the present invention, together with other and further objects thereof, reference is had to the following description taken in connection with the accompanying drawings, and its scope will be pointed out in the appended claims.

In the Drawings

Figure 2:
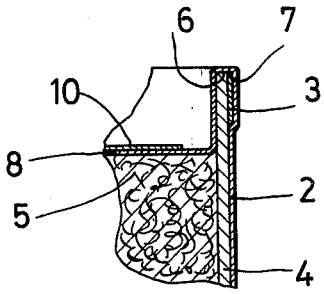

FIG. 1 is a perspective view of the package in accordance with the present invention; and FIG. 2 is a fragmentary enlarged sectional view of the package taken along lines II—II of FIG. 1.

Referring now to the drawings, there is shown a package 1 comprising a tubular outer sleeve 2 having suitable closures at opposite axial ends and to which is attached a narrow, elongated, tear strip 3 in the upper region of the sleeve essentially circumscribing the periphery thereof. Disposed within the sleeve 2 is a tube-like reinforcing member 4 disposed essentially co-planar with and abutting the sleeve 2 and preferably formed of thin cardboard. The package has a contents 5.

More specifically, the outer sleeve 2 is composed of a single or multi-layer foil of the type used conventionally for the production of flexible and gas-tight bags. The reinforcing member 4 is at least regionally attached to the sleeve 2.

The relatively narrow elongated tear strip 3 is, in the preferred embodiment, composed of conventional materials effective to be heat sealed to the sleeve 2, in such a manner that the strip appears on the inside face of the sleeve 2 as shown in FIG. 2. Thus, in effect, being interposed between the outer sleeve 2 and the reinforcing member. The outer sleeve is shown of an overlap construction, although other means can be provided to permit the forward or pull section *3a* of the strip to extend out of the sleeve 2 so that the strip can be readily gripped and pulled for tearing off or separating the cover. Within the sleeve 2, as noted above, the tear strip 3 is detachably secured to and along the circumference of the reinforcing member 4 adjacent the upper border 6 thereof. The strip defines an upper edge 7 which is flush with or in juxtaposition to narrow edge 6 of the reinforcing member at their common end.

Trouble-free operation of the opening of the package can still be attained when the edges 6 and 7 have a slight distance of, e.g., 2 millimeters, due to manufacturing tolerances. Under these conditions, it is only necessary that this distance be bridged by a detachable seal providing an effective connection between the reinforcing member 4 and sleeve 2.

The detachable connection referred to in the preceding paragraph between member 4 and strip 3 or sleeve 2 can be established by means of adhesive material deposited upon the sleeve, for instance a self-sticking layer, or a thermoplastic layer secured to sleeve 2 or strip 3, not illustrated.

When the strip 3 contains, on both major planes, an adhesive deposit or layer and the sleeve 2 is formed of gas-tight packing material, it is possible to evacuate and remove the oxygen from the contents 5.

In a modification of the present invention, the package 1 is provided with a so-called fin-seal head closure 8 extending over the upper edge 6 of the member 4 and forming a trough, the closure 8 includes fold projections 9 of triangular configuration folded inwardly into the package and on the outside covered by an adhesive label or cover 10.

While there have been described what are at present considered to be the preferred embodiments of this invention, it will be obvious to those skilled in the art that various changes and modifications may be made therein without departing from the invention, and it is aimed, therefore, in the appended claims to cover all such changes and modifications as fall within the true spirit and scope of the invention.

What is claimed is:

1. A package comprising in combination:

a closed outer sleeve of generally bag-like configuration;

a generally tubular reinforcing member extending within at least the upper region of said outer sleeve, said reinforcing member being at least regionally secured to said sleeve;

a flat tear strip interposed between said outer sleeve and said tubular reinforcing member and detachably attached to the reinforcing member and connected to said outer sleeve, the strip and the tubular reinforcing member defining a common end arranged substantially flush with respect to each other.

2. A package according to claim 1, wherein said tear strip extends around the periphery of said reinforcing member.

3. A package according to claim 1, wherein said strip protrudes outwardly beyond said outer sleeve.

4. A package according to claim 3, wherein said outer sleeve is provided with an overlap seam and said strip protrudes out of the layers constituting said overlap.

5. A package according to claim 1, and seal means between and bridging said reinforcing member and said sleeve in the region of said common end.

* * * * *